US006830017B2

(12) United States Patent
Wolf et al.

(10) Patent No.: US 6,830,017 B2
(45) Date of Patent: Dec. 14, 2004

(54) INTERNAL COMBUSTION-ENGINED TOOL

(75) Inventors: Iwan Wolf, Chur (CH); Ulrich Schiestl, Feldkirch (AT); Ulrich Rosenbaum, Wangs (CH); Hans Gschwend, Buchs (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/618,826

(22) Filed: Jul. 14, 2003

(65) Prior Publication Data

US 2004/0079302 A1 Apr. 29, 2004

(30) Foreign Application Priority Data

Jul. 16, 2002 (DE) ..... 102 32 035

(51) Int. Cl.[7] ..... F02B 71/00
(52) U.S. Cl. ..... 123/46 R; 227/130
(58) Field of Search ..... 123/46 R, 46 SC, 123/46 A, 46 B, 46 E, 46 H; 227/9, 10, 130

(56) References Cited

U.S. PATENT DOCUMENTS 4,920,928 A * 5/1990 Hammett ..... 123/46 SC
6,491,002 B1 * 12/2002 Adams ..... 123/46 R
6,634,325 B1 * 10/2003 Adams ..... 123/46 R

FOREIGN PATENT DOCUMENTS

DE 4243614 A1 * 6/1994 ..... F02B/71/04
DE 4243617 A1 * 6/1994 ..... B25C/1/08

* cited by examiner

*Primary Examiner*—Tony M. Argenbright
*Assistant Examiner*—Hyder Ali
(74) *Attorney, Agent, or Firm*—Sidrey Austin Brown & Wood, LLP

(57) ABSTRACT

An internal combustion-engined setting tool includes a drive piston (15) displaceably supported in the piston guide (17) and displaceable in a setting direction (4) by expandable gases produced in the main combustion chamber (11) of the tool and pre-chamber (20) for generating pressure that is transmitted to the main combustion chamber (11) before the ignition (19) of the air-fuel mixture in the main combustion chamber takes place, with the pre-chamber (20) being formed by space a within the piston guide (17) beneath a bottom of the drive piston (15) remote from the main combustion chamber (11), when the drive piston occupies its initial position, and with the pre-chamber (20) being connected with the main combustion chamber (11) by a transfer guide.

10 Claims, 7 Drawing Sheets

INTERNAL COMBUSTION-ENGINED TOOL

BACKGROUND OF THE INVENTION

1. Field of the Invention

The present invention relates to an internal combustion-engined setting tool for driving fastening elements, such as, e.g., bolts, nails, etc. . . . into a constructional component and including at least one main combustion chamber, a piston guide adjoining the main combustion chamber, a drive piston displaceably supported in the piston guide and displaceable in a setting direction by expandable gases produced in the main combustion chamber upon ignition of a compressible fuel filling the main combustion chamber, a pre-chamber for generating a pressure that is transmitted to the main combustion chamber before the ignition of the air-fuel mixture in the main combustion chamber takes place.

2. Description of the Prior Art

Setting tool of the type described above can be operated with gaseous or evaporated liquid fuels which are combusted in a combustion chamber for driving a setting piston that drives the fastening elements in.

In the setting tools of the type described above, It is desirable to achieve the most possible thermal efficiency.

German Publication DE-4243617A1 discloses a setting tool in which beneath the drive piston, in the setting direction, a pre-combustion space is provided in an axiliary cylinder. In its initial position, the drive piston is located immediately above the precombustion space and is spaced from the main combustion chamber. The pre-compression of the air-fuel mixture in the main combustion chamber is effected in the setting tool of DE-4243617A1 by ignition of the air-fuel mixture that fills the pre-combustion space, whereby the piston is accelerated toward the main combustion chamber, which leads to an isentropic compression of the air-fuel mixture above the drive piston and in the main combustion chamber.

The drawbacks of the setting tool of DE-4243617A1 consist in that it is constructively very complex and requires additional space for additional chambers, and in that manufacture of its is associated with very high costs.

Accordingly, an object of the present invention is to provide an internal combustion-engined setting tool of the type described above in which the drawbacks of the known setting tool are eliminated and a high thermal efficiency is achieved.

SUMMARY OF THE INVENTION

This and other objects of the present invention, which will become apparent hereinafter, are achieved by providing a pre-chamber which is formed by space within the piston guide and beneath a bottom of the drive piston remote from the main combustion chamber when the drive piston occupies its initial position, and a transfer channel for communicating the pre-chamber and the main combustion chamber.

Hence, it is suffice for the pre-chamber be formed by the expansion space of the drive piston within the piston guide. The expansion space is defined as space within the piston guide beneath the bottom of the drive piston when the drive piston is in its initial position and adjoins the bottom of the main combustion chamber. By using the piston expansion space as a pre-chamber, the increase of pressure in the main combustion chamber can be achieved during a setting process without a need in additional space and complex mechanical measures.

Between the pre-chamber and the main combustion chamber, a transfer channel is provided through which the pressure medium produced in the pre-chamber can flow into the main combustion chamber, which results in pressure increase in the main combustion chamber. Providing a transfer channel between the pre-chamber, which can be formed, e.g., by the expansion space of the drive piston in the piston guide, and the main combustion chamber permits to provide a construction that can be easily and cost-effectively produced and that, at the same time, is characterized by a high thermal efficiency due to the precompression of the air-fuel mixture in the main combustion chamber.

It is very advantageous when the pre-chamber is formed as a combustion chamber in which an air-fuel mixture is ignited, with the combustion gases and, eventually, flame front flowing through the transfer channel into the main combustion chamber where they provide for increase of pressure therein and, eventually, the turbulence. In the main combustion chamber, the air-fuel mixture, which fills the chamber, becomes pre-compressed and is ignited after a predetermined pressure is reached.

In the transfer channel, there is provided a valve, in particular, a check valve that provides for medium flow from the pre-chamber into the main combustion chamber but that prevents the medium flow in the opposite direction. In particular, the check value closes the transfer channel immediately after the air-fuel mixture in the main combustion chamber has been ignited.

According to a further modification of the present invention, advantageously, the pre-chamber is divided in two chambers, a pre-combustion chamber in which an air-fuel mixture can be ignited, and a pressure chamber which contains air by the point in time at which ignition in the pre-combustion chamber takes place. Advantageously, the pre-combustion chamber and the pressure chamber are separated by a plate. Ideally, the separating plate is displaceably supported on the piston rod of the drive piston and is sealed against the piston guide and the piston rod. Upon the ignition of the air-fuel mixture in the pre-combustion chamber, the separating plate is displaced under the pressure of the generated explosion gases in the direction toward the pressure chamber, so that the pressure in the pressure chamber increases. The pressure increase in the pressure chamber leads to opening of the valve in the transfer channel, and the air flows from the pressure chamber into the main combustion chamber, increasing pressure therein.

Advantageously, there are provided, in the main combustion chamber, detection means, which can be formed, e.g., as a sensor for detecting pressure in the main combustion chamber, and ignition means for igniting the air-fuel mixture in the main combustion chamber and actuatable in response to the detection means detecting a predetermined pressure in the main combustion chamber, which pressure is increased as a result of flow of medium from the pre-chamber into the main combustion chamber. In this way, the ignition of the air-fuel mixture in the main combustion chamber can be effected automatically, without intervention of a user.

It is advantageous when the valve means in the transfer channel is so formed that it provides for flow of not only gas or vapor-forming medium but also provides for passage of a reaction front, e.g., a flame front from the pre-chamber or the pre-combustion chamber into the main combustion chamber. This measure permits to effect, in a simple manner, the ignition of the air-fuel mixture in the main combustion chamber by overflow of the flame front together with the pressure front from the pre-chamber.

To provide for a permanent pressure increase, there is provided magnetic holding means for retaining the drive piston in its initial position with a predetermined holding force.

The magnetic holding means can be arranged either in the region of the main combustion chamber or in the region of the piston guide. The holding force is so selected that the pressure increase in the main combustion chamber, as a result of overflow of medium from the pre-chamber, by itself does not provide for displacement of the drive piston from its initial position. The release and displacement of the drive piston in the setting direction takes place only upon the ignition of the air-fuel mixture in the main combustion chamber and as a result, upon a further increase of pressure therein, with the further increased pressure overcoming the holding force of the magnetic means.

Advantageously, a mouth opening of the transfer channels opens into the pre-chamber immediately beneath the drive piston when the drive piston is in its initial position. Thereby, the transfer channel becomes closed immediately, after the release of the drive piston.

The novel features of the present invention, which are considered as characteristic for the invention, are set forth in the appended claims. The invention itself, however both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

As discussed above, FIGS. 1 through 5 show a first embodiment of an internal combustion-engined setting tool according to the present invention in different positions of the tool. Actually, FIGS. 1–5 show not an entire tool but only the setting mechanism of the inventive setting tool.

Figure 1:
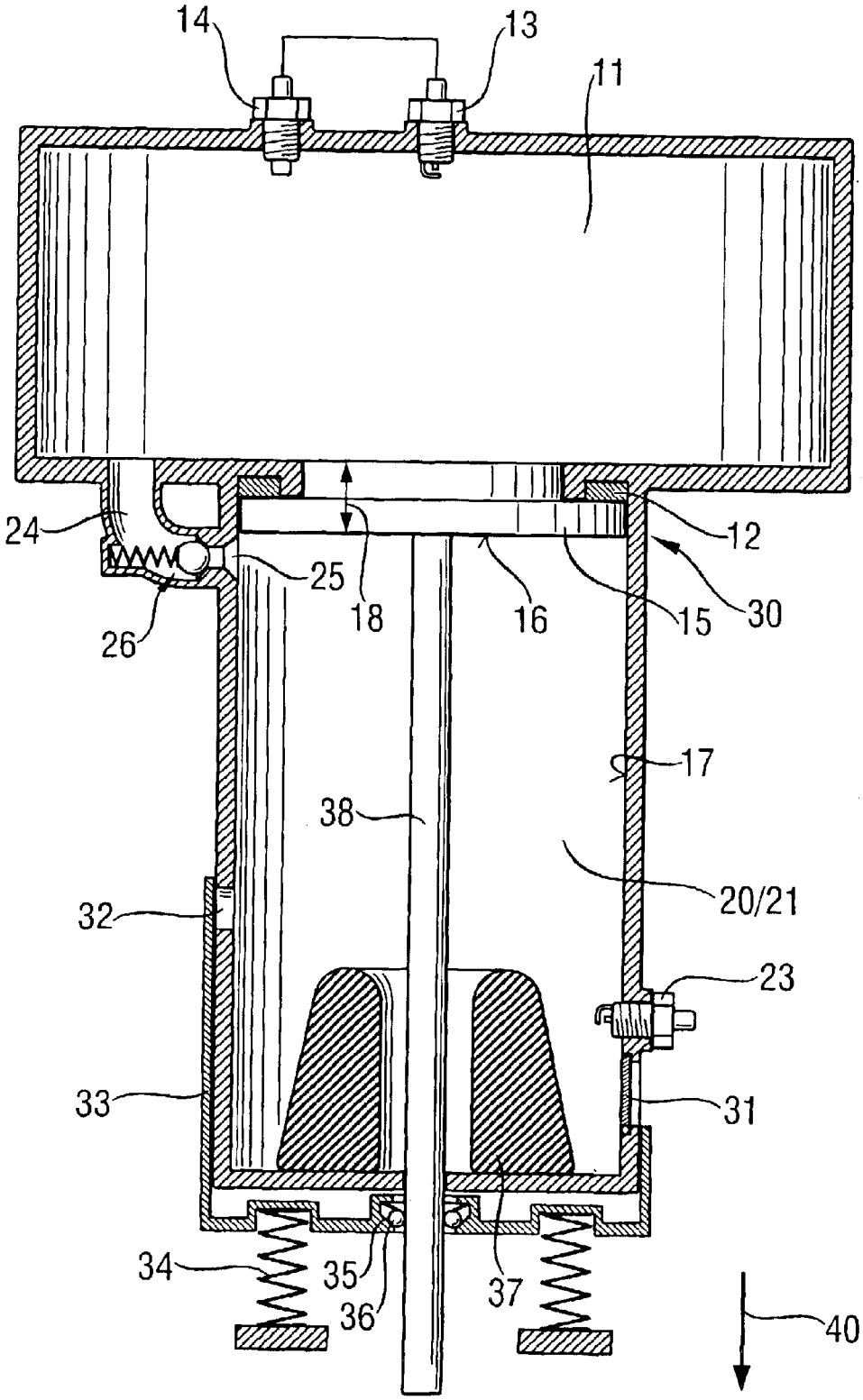
FIG. 1 a cross-sectional view of a main combustion chamber and a piston guide of an internal combustion-engined setting tool in an initial position of the tool.

FIG. 1 shows the setting mechanism of the first embodiment of the setting tool in its off-or initial position. In addition to the setting mechanism, the setting tool includes other well-known components, such as a housing, electronic components, a magazine for fastening elements, etc.

The internal combustion-engined setting tool according to the present invention can be operated with a fuel gas or with vaporized liquid fuel. With the setting mechanism, fastening elements, such as nails, bolts, and the like are driven in a constructional component when the setting tool is pressed with its bolt guide (not shown) against the constructional component and is actuated.

The settling mechanism includes, among others, a main combustion chamber 11, a piston guide 17 in which a drive piston 15 is displaceably supported, and a bolt guide for guiding a fastening element. The fastening element is driven in a constructional component by a setting direction end of the drive piston 15 or of the piston rod 38. The bolt guide (not shown) adjoins a side of the piston guide 17 facing in a setting direction 40. As it has been mentioned above, the fastening elements can be stored in a magazine attachable to the setting tool.

In the embodiments shown in the drawings, the main combustion chamber 11 includes an ignition device 13, e.g., an ignition plug for igniting an air-fuel mixture injected into the main combustion chamber for effecting a setting process. For feeding of the fuel into the combustion chamber 11, there is provided a feeding conduit (not shown) connected with a fuel reservoir or a fuel source. The main combustion chamber 11 further includes means 14 for detecting pressure, e.g., a pressure sensor. The sensor can provide for an automatic ignition of the air-fuel mixture in the main combustion chamber 11 when a predetermined pressure is reached. For evaluation of the pressure signal generated by the detection means 14 and for comparison of the signal with a preset value, the ignition device 13 and the detection means 14 can be associated with control electronics for effecting an automatic ignition.

For retaining the drive piston 15 in its initial position 30 at an end of the piston guide 17 adjacent to the main combustion chamber 11, with a predetermined holding force, magnets 12 are provided in the transition region between the main combustion chamber 11 and the piston guide 17.

From the bottom 16 of the drive piston 15, within the piston guide 17, extends a pre-chamber 20 which is formed as a pre-combustion chamber 21 and in which a further ignition unit 23 is arranged. Directly beneath the drive piston 15 when the drive piston 15 in its initial position 30, a mouth 25 of a passage or transfer channel 24 that connects the pre-combustion chamber 21 with the main combustion chamber, is located. The initial position 30 of the drive piston 15, the embodiment shown in FIGS. 1–5, corresponds to the dead point of the drive piston 15.

The distance between an end of the main combustion chamber 11 facing in the setting direction 40 and the mouth 25 of the transfer channel 24 corresponds essentially to an axial thickness 18 of the drive piston 15. A valve 26 is arranged in the transfer channel 24. The valve 26 is a check valve that under normal condition, disconnects the main combustion chamber 11 from the pre-combustion chamber 21. The check valve 26 provides for flow 42 of a medium from the pre-combustion chamber 21 into the main combustion chamber 11 when overpressure is created in the pre-combustion chamber 21, but prevents the medium flow in the opposite direction from the main combustion chamber 11 into the pre-combustion chamber 21.

At the setting direction end of the piston guide 17, there is (are) provided one or more damping stop members 37 for the drive piston 15, which prevent a direct impact of drive piston is again the bottom of the piston guide 17.

In the region of the setting direction end of the piston guide 17, an outlet 32 is provided. Opposite the outlet 32 and at an angle thereto, an air inlet valve 31 is arranged. In the position shown in FIG. 1, the air inlet valve 31 is closed. In the position shown in FIG. 1, the outlet 32 is likewise closed, e.g., by a control sleeve 33. The control sleeve 33 is spring-biased in a direction opposite the setting direction 40 by springs 34 supported at their ends remote from the control sleeve 33 against a tool housing (not shown). In the bottom of the control sleeve 33, an opening, through which the piston rod 38 extends, is provided. In the opening which is provided in the bottom of the control sleeve 33, there is provided a cone 35 against which balls 36 are supported. The functions of the control sleeve 33 and the arrangement cone 35/balls 36 will be explained in detail further below.

As discussed above, FIG. 1 shows the initial position of the setting tool. In the position shown in FIG. 1, a combustible air-fuel mixture is already available in the pre-combustion chamber 21, and the setting tool is already pressed against a constructional component (not shown). The main combustion chamber 11 is sealed against the atmosphere and is closed from the pre-combustion chamber 21 by the drive piston 15. The combustible air-fuel mixture is likewise available in the main combustion chamber 11. The air-fuel mixture is fed into the main combustion chamber 11 by an injection device and/or through an inlet valve (not shown) after or during the time the setting tool is being pressed against the constructional component.

Figure 2:
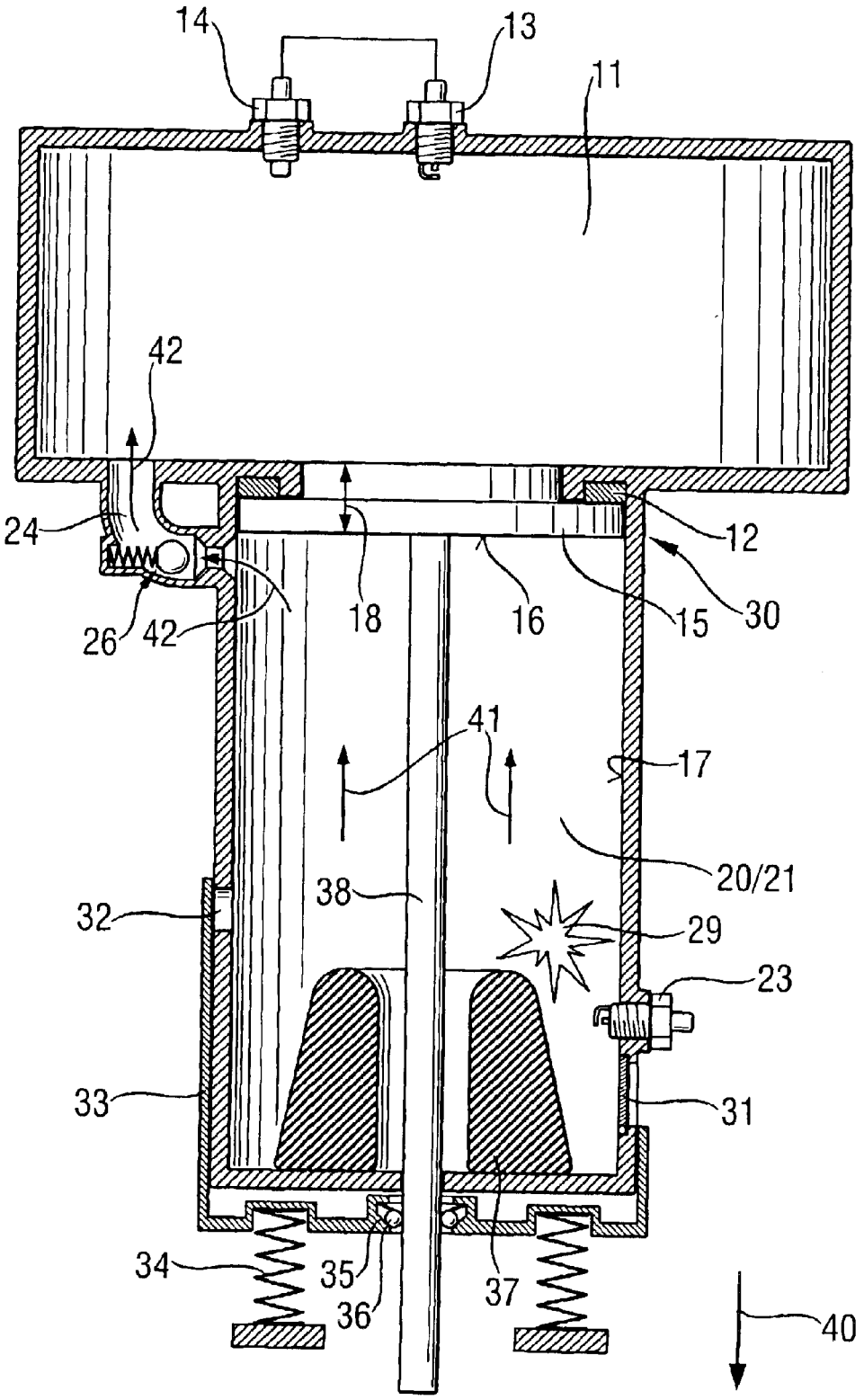
FIG. 2 a cross-sectional view of the setting tool shown in FIG. 1 in a position following preignition.

FIG. 2 shows a position in which the setting tool has already been actuated by a trigger or an actuation device (not shown). Upon actuation of the setting tool, the ignition unit 23 is also actuated so that ignition 29 takes place. The increase of pressure in the pre-combustion chamber 21, which results from an explosive combustion of the air-fuel mixture, causes the non-combusted gases and/or reaction gases to flow in directions 41, 42 and through the transfer channel 24, with the check value 26 being opened by the increased pressure, into the main combustion chamber 11. The inflow gases increase the pressure in the main combustion chamber 11.

Figure 3:
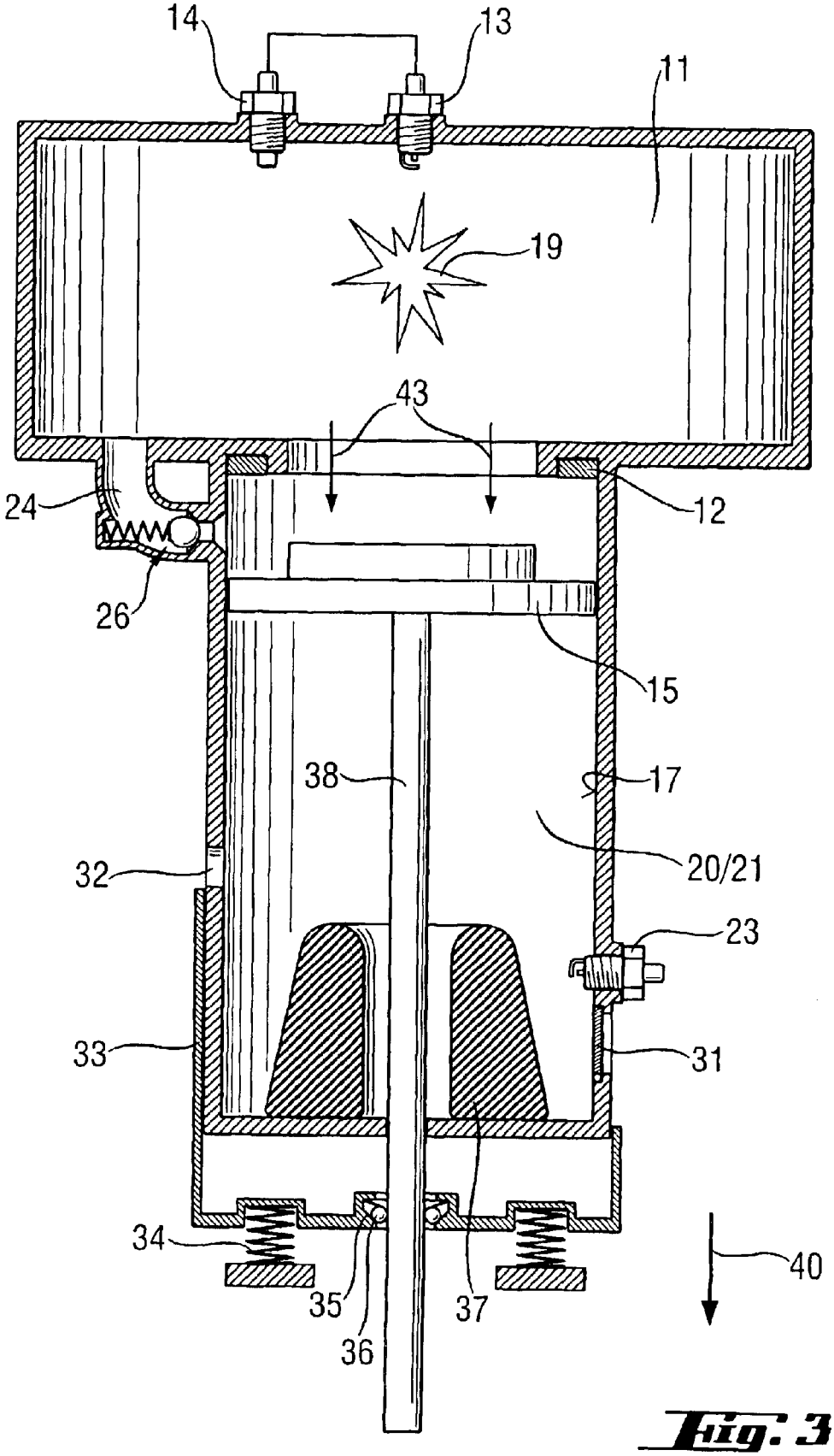
FIG. 3 a cross-sectional view of the setting tool shown in FIG. 1 in a position following a main ignition.

After a predetermined pressure, which is detected by the detection means 14, is reached, the ignition device 13 is actuated, and ignition 19 takes place, as shown in FIG. 3. As a result of combustion and pressure, the reaction gases 43, which act on the drive piston 15, overcome magnetic forces of the magnetic means 12, and the drive piston 15 is displaced forward in the setting direction 40. The forward movement of the drive piston 15 and its piston rod 38 provides for movement of the control sleeve 33 forward against the biasing force of the, springs. The forward movement of the control sleeve 40 results from frictional engagement of the piston rod 38 with the arrangement cone 35/balls 36. The forward movement of the control sleeve 33 open the outlet 32 through which waste gases, which are produced by precombustion, flow outside of the piston guide 17. During the forward movement of the drive piston 15 the piston rod 38 drives a fastening element into a constructional component.

Figure 4:
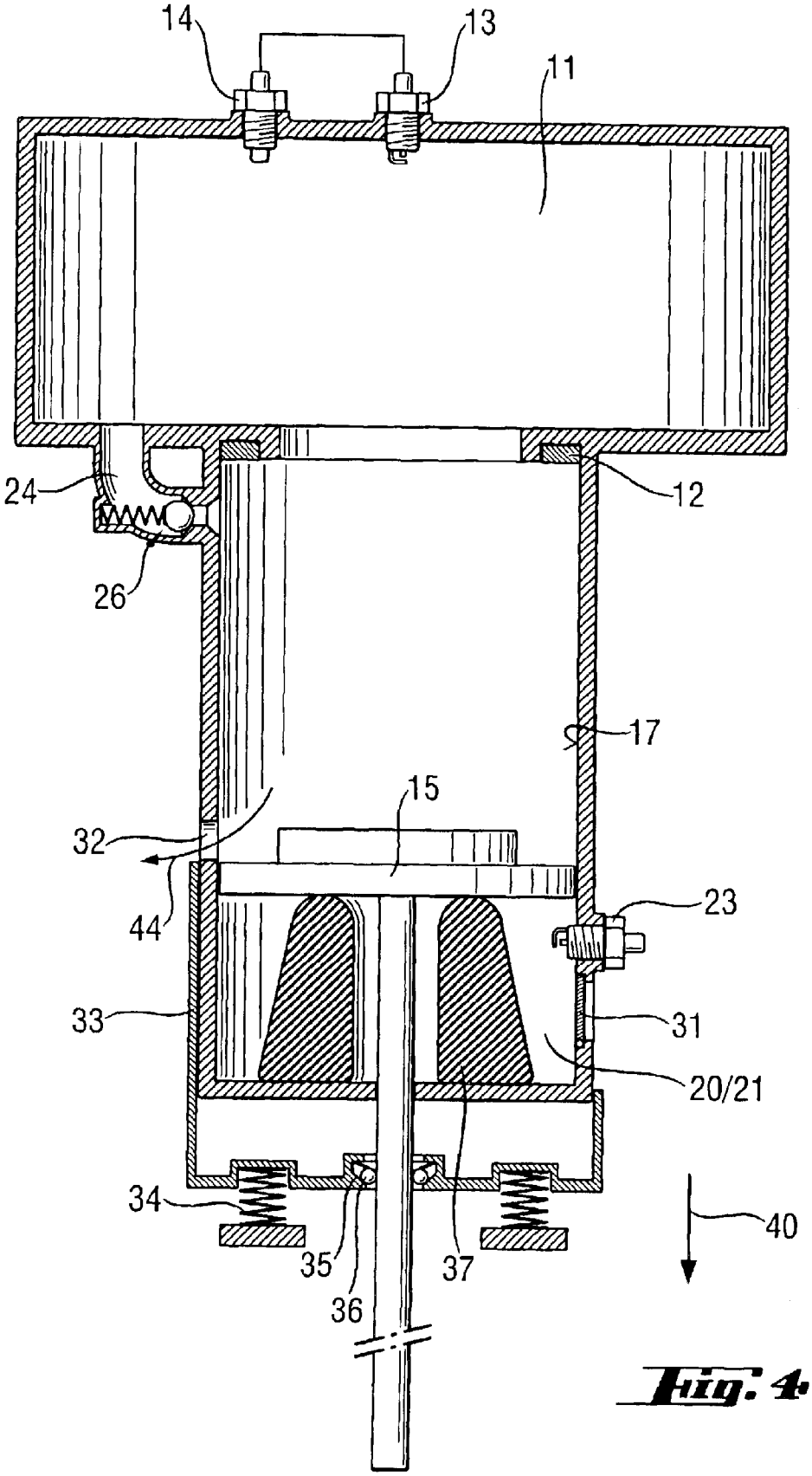
FIG. 4 a cross-sectional view of the setting tool shown in FIG. 1 in the end position of the drive piston.
Figure 5:
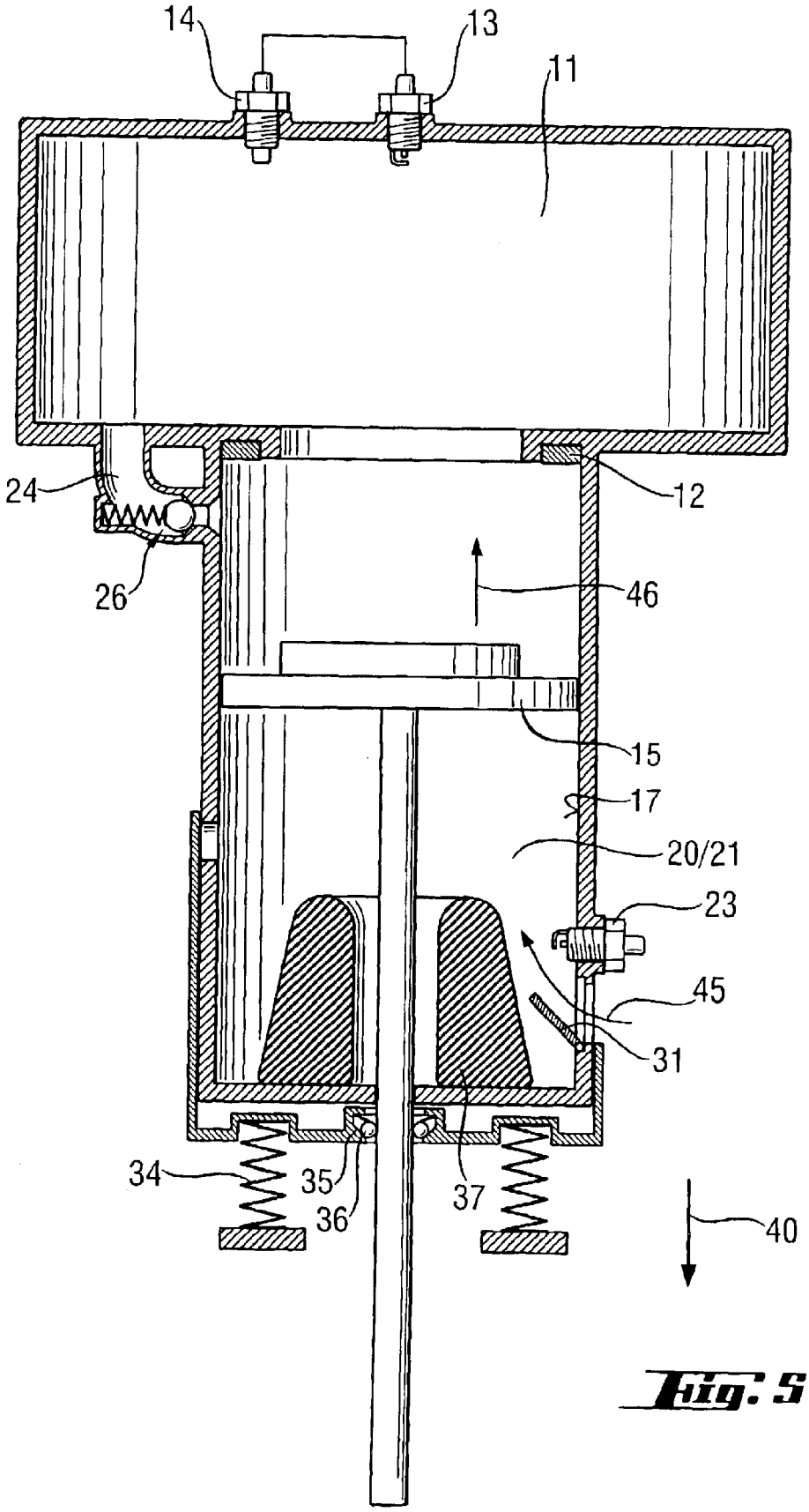
FIG. 5 a cross-sectional view of the setting tool shown in FIG. 1 in an intermediate, following the completion of a setting process, position before the drive piston reaches its initial position.

During its forward movement, the drive piston 15 passes the outlet 32, so that the waste gases from the main combustion chamber 11 can also flow outside, as shown with arrow 44 (FIG. 4). When the drive piston 15 reaches its end position, which is shown in FIG. 4, cooling of gases, which remain in the main combustion chamber 11 and in space of the piston guide 17 above the drive piston 15, provides for return of the piston 15 from its end position to its initial position 30. The return movement of the drive piston 15, together with the piston rod 38, provides for release of the balls 36. As a result, the control sleeve 33 is biased by the springs 34 to its closing position in which it closes the outlet 32 (FIG. 5). As further shown in FIG. 5, as a result of suction, which is produced by the return movement of the piston 15 to its initial position 30 in the direction shown with arrow 46, the air inlet valve 31 opens, and the air flows into the pre-combustion chamber 21 as shown with arrow 45.

When the drive piston 15 is again in its initial position 30 and is retained by the magnets 12, the air is injected into the main combustion chamber 11 through an inlet (not shown). Upon pressing of the setting tool against a constructional component, the cycle, which was described above, is repeated.

Figure 6:
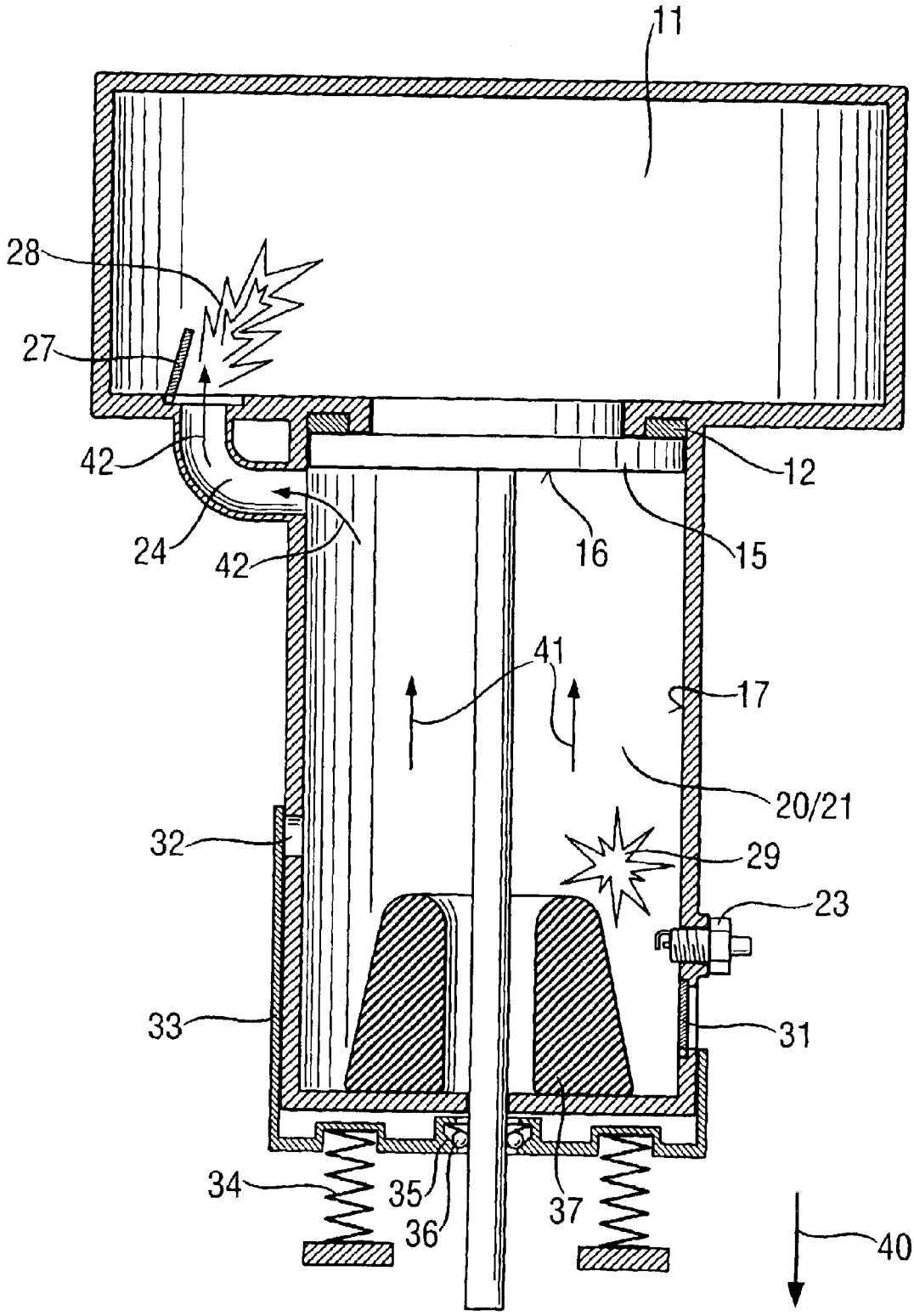
FIG. 6 a cross-sectional view of a second embodiment of an internal combustion-engined setting tool according to the present invention in a position corresponding to the position shown in FIG. 2 after preignition.

A setting tool, which is shown in FIG. 6, differs from that shown in FIGS. 1–5 in that instead of a check valve, there is provided a valve flap 27 for closing the transfer channel 24. In this embodiment, upon the ignition 29 having taken place, the reaction gases, which flow in the directions 41,42 press the valve flap 27 outwardly so that the already formed flame front 28 can enter the main combustion chamber 11. The flame front 28 ignites the air-fuel mixture in the main combustion chamber 11. Further functional steps are the same as in the setting tool shown in FIGS. 1–5.

Figure 7:
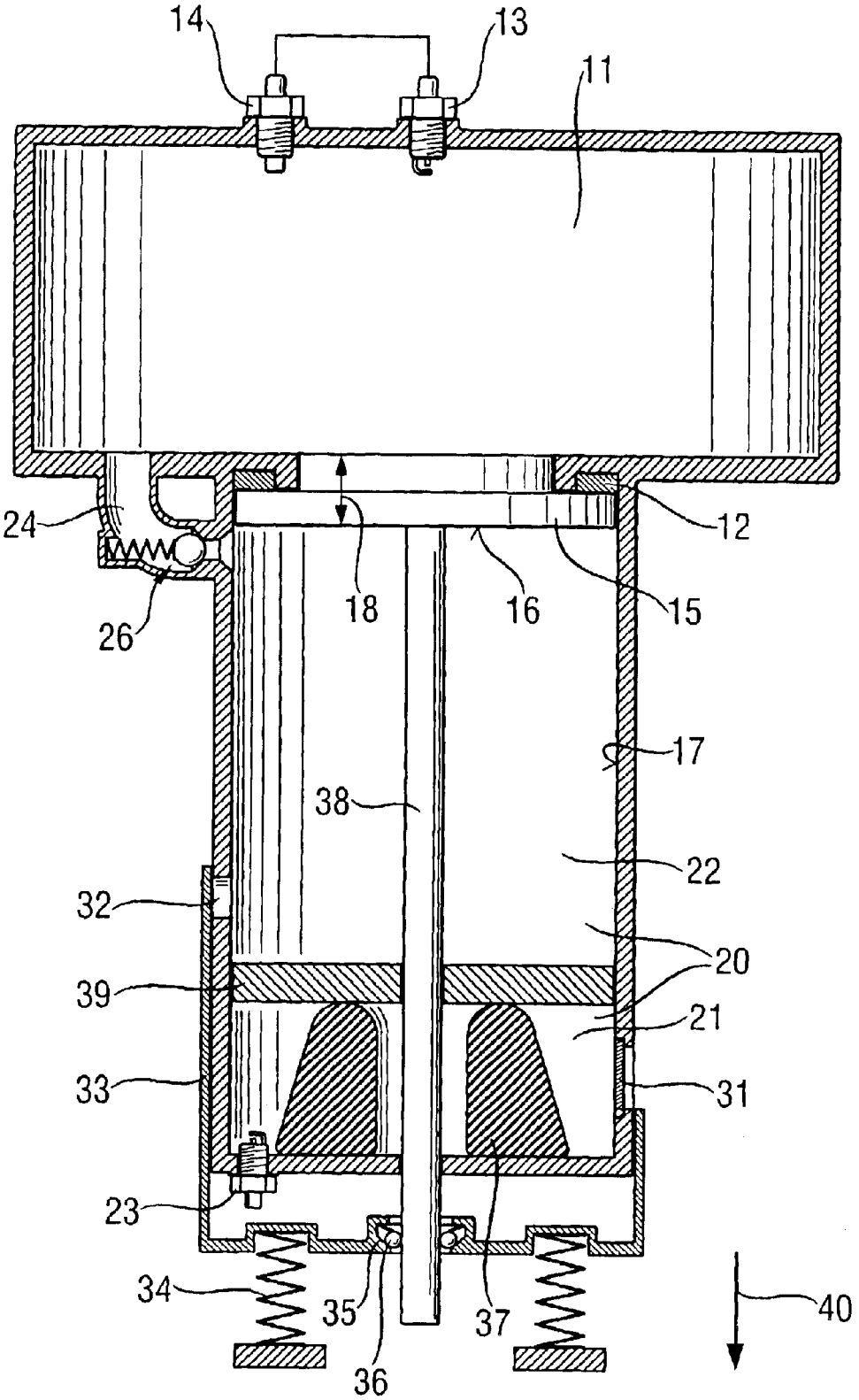
FIG. 7 a cross-sectional view of a third embodiment of an internal combustion-engined setting tool in an initial position.

The setting tool, which is shown in FIG. 7, differs from that shown in FIGS. 1–5, in that within the pre-chamber 20, a plate 39 is arranged. The plate 39 is displaceably supported on the piston rod 38. The plate 39 separates and seals the pre-combustion chamber 21, which is provided in the embodiment of FIG. 7 between the plate 39 and the bottom of the piston guide 17, from the pressure chamber 22 located between the bottom of the drive piston 15 and the plate 39. Upon the ignition of the air-fuel mixture in the pre-combustion chamber 21 by the ignition unit 23, the pressure is transmitted to the chamber 22 by the plate 39 that moves under pressure in the direction opposite the setting direction 40. The increased pressure opens the check valve 26 in the passage 24 and the increased pressure in the pre-chamber 20 is transmitted to the main combustion chamber 11. Upon the pressure in the main combustion chamber 11 reaching a predetermined value ignition of the air-fuel mixture in the main combustion chamber 11 with the ignition device 13 takes place.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. An internal combustion-engined setting tool for driving in fastening elements, comprising at least one main combustion chamber (11); a piston guide (17) adjoining the main combustion chamber (11); a drive piston (15) displaceably supported in the piston guide (17) and displaceable in a setting direction (40) by expandable gases produced in the main combustion chamber (11) upon ignition of a compressible fuel filling the main combustion chamber (11); a pre-chamber (20) for generating a pressure that is transmitted to the main combustion chamber (11) before the ignition (19) of the air-fuel mixture in the main combustion chamber takes place, the pre-chamber (20) being formed by a space within the piston guide (17) beneath a bottom of the drive piston (15) remote from the main combustion chamber (11) when the drive piston occupies an initial position thereof, and a transfer channel (24) for communicating the pre-chamber (20) and the main combustion chamber (11).

2. A setting tool according to claim 1, wherein the pre-chamber (20) comprises a pre-combustion chamber (21), and wherein the setting tool further comprises valve means (26; 27) provided in the transfer channel (24) for communicating, at least temporarily, the pre-combustion chamber (21) with the main combustion chamber (11).

3. A setting tool according to claim 1, wherein the pre-chamber (20) comprises a pre-combustion chamber (21) and a pressure chamber (22), and wherein the setting tool further comprises valve means (26; 27) provided in the transfer channel (24) for communicating, at least temporarily, the pressure chamber (22) with the main combustion chamber (11).

4. A setting tool according to claim 3, further comprising a plate (3) for separating the pre-combustion chamber (21) from the pressure chamber (22) and displaceably supported on a piston rod (38) of the drive piston (15).

5. A setting tool according to claim 1, further comprising detection means (14) for detecting pressure in the main combustion chamber (11); and ignition means (13) for igniting the air-fuel mixture in the main combustion chamber (11) and actuated in response to the detection means (14) detecting a predetermined pressure in the main combustion chamber (11).

6. A setting tool according to claim 2, wherein the valve means (26; 27) comprises a check valve (26).

7. A setting tool according to claim 6, wherein the check valve (26) is so arranged in the transfer channel (24) that it provides for flow of a medium (42) from the pre-chamber (20) to the main combustion chamber (11) but prevents flow of the medium in an opposite direction.

8. A setting tool according to claim 2, wherein the valve means (27) forms a passage for an expandable flame front (28) leaving the pre-chamber (20).

9. A setting tool according to claim 1, further comprising magnetic holding means (12) for retaining the drive piston (15) in the initial position (30) thereof with a predetermined holding force.

10. A setting tool according to claim 1 wherein the transfer channel (24) has a mouth opening (25) which opens into the pre-chamber (20) and is spaced from the main combustion chamber (11) by a distance corresponding to an axial thickness (18) of the drive piston (15).

* * * * *